United States Patent [19]

Mikulec et al.

[11] Patent Number: 4,813,487

[45] Date of Patent: Mar. 21, 1989

[54] FIRE EXTINGUISHER INSTALLATION

[76] Inventors: Conrad S. Mikulec, 2400 NE 26th St., Fort Lauderdale, Fla. 33305; Robert L. Quinn, 4340 NW. 19th Ave., Fort Lauderdale, Fla. 33309

[21] Appl. No.: 4,670

[22] Filed: Jan. 20, 1987

[51] Int. Cl.[4] ..... A62C 3/00

[52] U.S. Cl. ..... 169/65; 169/26; 169/37; 169/57; 239/587; 251/74

[58] Field of Search ..... 169/65, 57, 37, 70, 169/26, 58, 19, 51; 239/209, 587, 396, 487; 340/590; 307/117; 251/74

[56] References Cited

U.S. PATENT DOCUMENTS

| | | | |
|---|---|---|---|
| 812,001 | 2/1906 | Bilz | 169/26 X |
| 1,837,619 | 12/1931 | Heckert | 169/26 |
| 2,519,350 | 8/1950 | Cahusac | 169/26 |
| 3,605,735 | 9/1971 | Soden | 239/587 X |
| 3,653,443 | 4/1972 | Dockery | 169/65 X |
| 3,824,374 | 7/1974 | Mayher | 169/65 X |
| 3,866,687 | 2/1975 | Banner | 169/26 X |
| 3,889,754 | 6/1975 | Dunn | 169/65 X |
| 3,897,828 | 8/1975 | Glover | 169/65 X |
| 4,256,181 | 3/1981 | Searcy | 169/65 |
| 4,313,501 | 2/1982 | Eckert | 169/57 X |
| 4,580,638 | 8/1986 | Jones et al. | 169/65 X |

FOREIGN PATENT DOCUMENTS

| | | | |
|---|---|---|---|
| 3344745 | 6/1985 | Fed. Rep. of Germany | 169/57 |
| 1168708 | 12/1958 | France | 251/74 |

*Primary Examiner*—Joseph F. Peters, Jr.
*Assistant Examiner*—James M. Kannofsky
*Attorney, Agent, or Firm*—Hurt, Richardson, Garner Todd & Cadenhead

[57] ABSTRACT

An automatically activated fire extinguishing device for a stove. The device is installable in a hood over the stove and has a compact design which substantially hides portions of the device from normal viewing. The invention also includes an automatic stove shut-off which shuts off the electricity or gas to the stove in the event of a fire.

12 Claims, 4 Drawing Sheets

FIRE EXTINGUISHER INSTALLATION

BACKGROUND OF THE INVENTION

The use of automatically activated fire extinguishing devices for cooking stoves and the like is known. Such devices provide a source of fire extinguishing compound to be released onto a stove surface in the event of a cooking fire. Such prior art devices, however, are relatively bulky, the fire extinguishing compound generally being stored in a container at a location remote from the stove with a piping arrangement connecting the container with the stove. A spraying device is located above the cooking surface, and the fire extinguishing compound is conveyed from the container, through the piping and out through the spraying device onto the fire.

These prior art devices have the disadvantage of requiring on-site installation time and expense over and above that required for the stove itself. Moreover, as the distance between the container and the spray device (e.g. nozzles) is increased, more propellant is required to transport the fire extinguishing compound, which in turn requires a larger container for storage of the propellant along with the fire extinguishing compound. In addition to the unsightly appearance of the fire extinguisher container and the piping from the container to the stove, the nozzles generally protrude down from above the stove and are both unsightly and may interfere with the activities of the stove operator.

The fire extinguishing device must also have a triggering mechanism positioned for sensing heat from a stove fire, and thus the triggering mechanism is located generally adjacent the cooking surface. Because of this location requirement, the triggering mechanism, like the nozzles, is readily visible and results in an unattractive appearance.

Prior art automatic fire extinguishing installations also may include an automatic shut-off arrangement for shutting off either the electricity or gas to the stove (depending on the stove type) upon detection of a fire. Known shut-off arrangements are generally complex and installable only by an electrician, and thus they also contribute to on-site installation time and expense.

There is thus a need in the art for a fire extinguishing device which is unobtrusive in appearance, is less bulky, and does not require a prohibitive amount of on-site installation time and expense. There is also a need in the art for an automatic shut-off arrangement for a stove which is simple in design and does not require expert assistance for installation.

DISCLOSURE OF THE INVENTION

It is accordingly an object of the invention to provide a fire extinguishing device for a stove which is less bulky than prior art devices.

It is another object of the invention to provide a device, as above, in which the fire extinguisher container, triggering mechanism and nozzles are substantially hidden from view by the stove operator.

It is yet another object of the invention to provide a device, as above, which does not require an extensive amount of on-site installation time and expense.

These objects are achieved by an apparatus for extinguishing a fire on a stove, the stove including a hood, the apparatus comprising (a) a container containing a fire extinguishing compound, the container including an opening and a means for propelling the compound through the opening, (b) a valve positioned in the opening and being operable to allow the fire extinguishing compound to exit through the opening, (c) at least one nozzle in fluid communication with the valve to receive the fire extinguishing compound exiting through the opening, the nozzle directing the fire extinguishing compound to extinguish a fire on the stove, (d) valve opening means contacting the valve, and (e) a heat sensitive triggering means for triggering the valve opening means upon detection of the fire.

BRIEF DESCRIPTION OF THE DRAWINGS

For a full understanding of the invention, the following detailed description should be read in conjunction with the drawings, wherein.

DETAILED DESCRIPTION OF THE PREFERRED EMBODIMENTS

Figure 1:
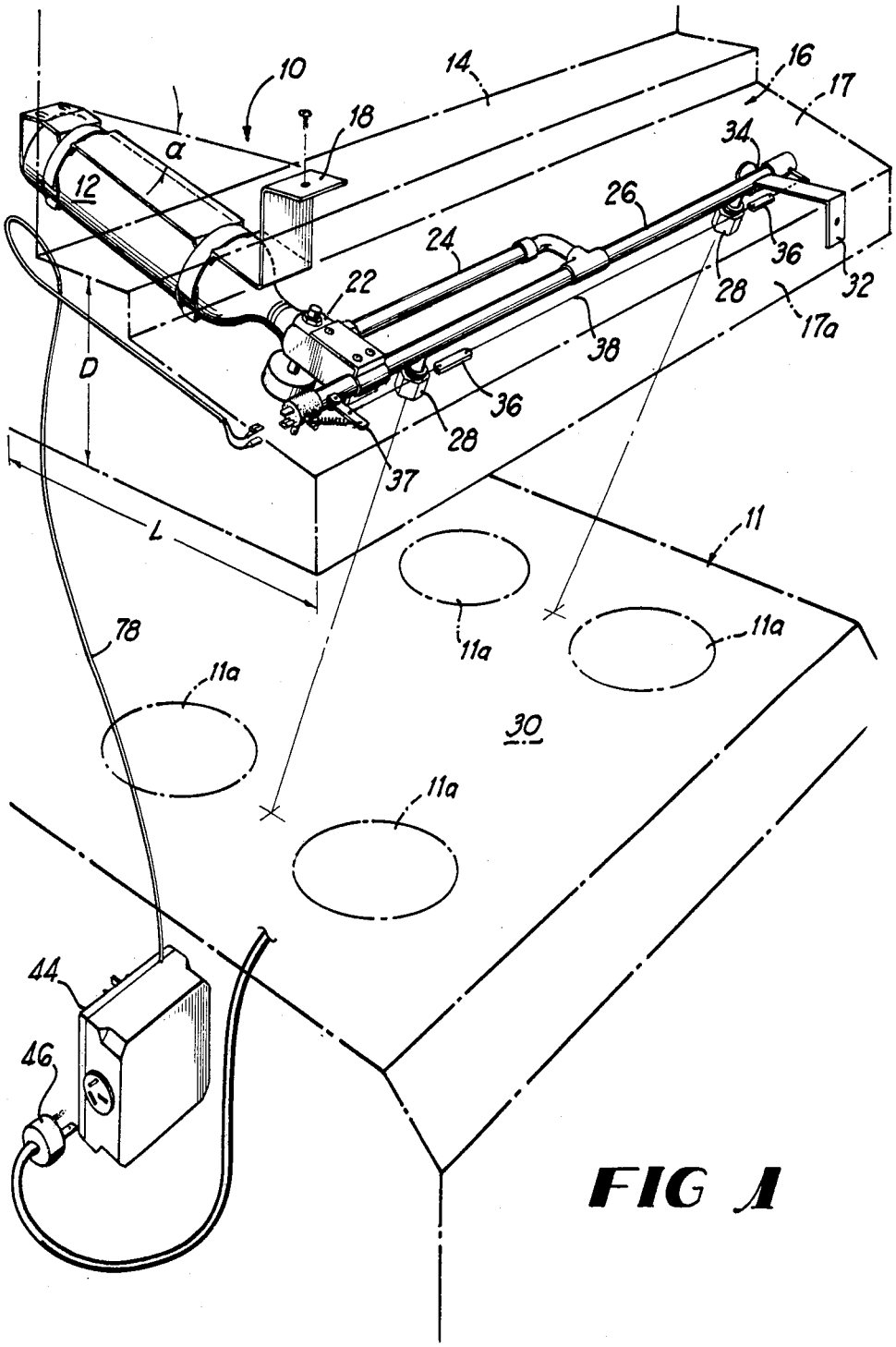
FIG. 1 is a perspective view of the fire extinguishing apparatus of the invention.

A stove 11 incorporating one embodiment of the invention is illustrated in FIG. 1, in which a fire extinguishing apparatus is indicated generally by the number 10. The apparatus is located above the stove 11, the stove 11 having electric burners 11*a*. A container 12, which is preferably a pressure vessel, holds a quantity of fire extinguishing compound and an appropriate propellant, and is secured to a horizontal portion 14 of a hood 16 by means of a bracket 18. The hood 16 includes a tilted portion 17 and a skirt 17*a* which is substantially vertical. The bracket 18 tilts the container 12 at an angle $\alpha$ to the horizontal, which can be between about 14° and 45° and most preferably is about 14°. This tilting facilitates both the discharge of the fire extinguishing compound from the container, and the positioning of the apparatus such that it is substantially hidden from view.

Figure 2:
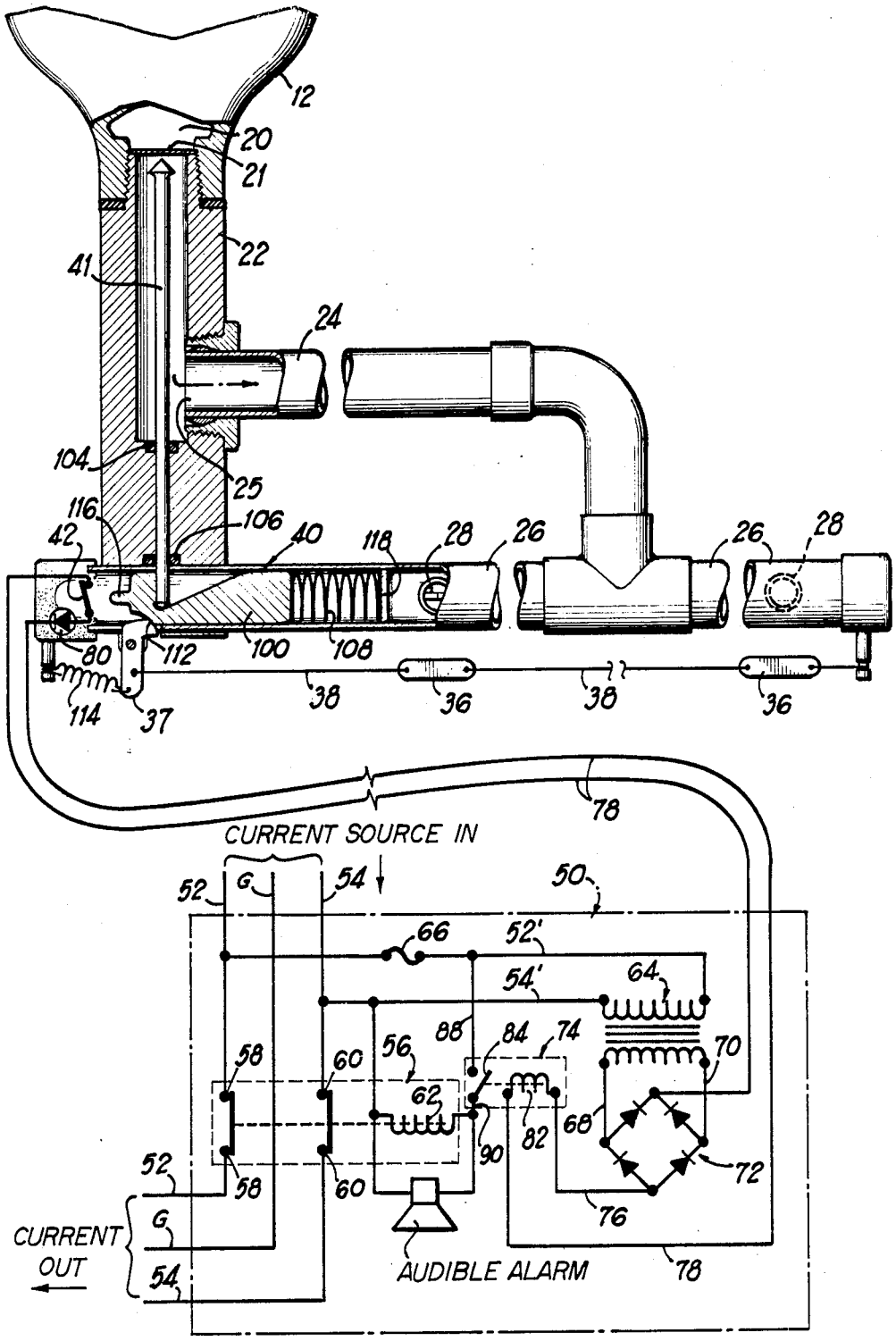
FIG. 2 is a sectional view of a first embodiment of the valve opening and triggering mechanism of the invention, along with an electrical schematic of the stove shut-off device of the invention.

As shown in FIGS. 1 and 2, the container 12 has an opening 20 through which the fire extinguishing compound is conveyed. A seal 21 is provided over the opening to retain the fire extinguishing compound prior to use. A valve 22 positioned in the opening punctures the seal 21 to release he fire extinguighing compound when the apparatus 10 is activated. Tube 24 attached to the side of valve 22 conveys fire extinguishing compound from the valve outlet 25 to a header 26 when the valve is open. Secured to the header are one or more nozzles 28 (FIG. 1) which direct the fire extinguishing compound to the stove surface 30 where the fire occurs. A clamp 32 can optionally be used to retain the far end 34 of the header to the hood 16.

Fusible links 36, trigger 37 and wires 38 function as a heat sensitive triggering means for triggering a valve opening mechanism 40, (FIG. 2) such that a rod 41 of valve 22 is pushed upward in an axial direction when one or more of the fusible links 36 break due to heat from a fire. The specifics of how this is brought about are discussed hereinafter.

A microswitch 42 is located adjacent to the valve opening mechanism 40 and interacts with the mechanism 40 to activate a stove shut-off mechanism 44 (FIG. 1). The stove shut-off mechanism 44 operates to break the flow of electricity to the stove via the stove plug outlet 46. The shut off mechanism plugs into an elecrical outlet (not shown) and the stove plug outlet 46 plugs into the shut-off mechanism 44. This arrangement for utilizing a stove shut-off eliminates the need for complex wiring by an electrician, since the installation can be performed in a very short time by one non-conversant in electrical circuitry.

While the embodiment shown in FIGS. 1 and 2 is adapted for an electrical stove having burners 11*a*, the invention is also applicable to a gas stove, the only difference being that the stove shut-off mechanism is positioned in a gas line to the stove and contains a valve arrangement for shutting off gas flow when a fire is present on the stove.

FIG. 2 also illustrates in detail the electrical schematic for the stove shut-off mechanism 44 as adapted for an electrical stove.

High voltage current enters a breaker box 50 of the stove shut-off mechanism 44 via wires 52 and 54. The breaker box 50 is grounded by wire G. Wires 52 and 54 feed current to the stove through a double pole single throw solenoid switch 56. Switch 56 includes contactors 58 and 60 to feed or interrupt the current through wires 52 and 54. Contactors 58 and 60 are energized through high voltage solenoid coil 62. Branching from wires 52 and 54 are wires 52' and 54' which feed current to a transformer 64 for converting the high voltage source to a low voltage (12 V) direct current. Wire 54 is fused at 66. Wires 68 and 70 feed transformed current to a bridge 72 which rectifies the current to feed a double pole single throw solenoid switch 74 via wires 76 and 78. Wire 78 is elongated and extends from the breaker box to the remotely located (over the stove cooking surface) microswitch 42. The microswitch 42 is normally closed. A light emitting diode 80 is lighted when current is present to provide a visual check that the system is operating normally. When the switch 42 is opened, current is broken in wire 78 by activation of the valve opening means 40, current is broken in wire 78. A coil 82 in switch 74 is deenergized, and switch contact 84 is released to make a circuit through high voltage wires 88 and 90. Wires 88 and 90 are fed from wires 52' and 54' to provide current to the previously described coil 62 of the solenoid switch 56 through switch 74.

The coil 62 of switch 56 is normally deenergized and current is allowed to flow uninterrupted through contact 58 and 60 to power the stove. When microswitch 42 is activated, current in the holding coil 82 of switch 74 releases contact 84 to energize coil 62 of switch 56 to pull contactors 58 and 60 out of engagement with wires 52 and 54 to break the high voltage feeding the stove. Additionally, if fuse 66 is shorted or receives a current surge, the transformer 64 will be deenergized which effects a deenergizing of coil 82 in switch 74 to release contact 84 which in turn sends current to the coil 62 of switch 56 to pull contacts 58 and 60 out of engagement with wires 52 and 54 to break the current to the stove.

The detailed structure of the valve 22 and the valve opening mechanism 40 are also shown in FIG. 2. A ramp 100 contacts rod 41 which is slidable along the ramp 100 when the ramp is moved. Movement of the ramp induces the rod 41 to move axially upward and to thereby puncture the seal 21. O-rings 104, 106 provide sealment of the valve 22 and rod 41 against leakage of the fire extinguishing compound. The opening 20 extends through the valve 22 and into tube 24.

The ramp 100 is biased leftward as shown in FIG. 2 by spring 108. Movement of the ramp in the leftward direction is prevented by trigger 110 which engages a notch 112 in the ramp. A spring 114, smaller than spring 108, biases trigger 110 in a clockwise direction. Fusible links 36 and wires 38 counteract the bias of spring 114 and maintain the trigger 110 in the notch-engaging position. A knob 116 can be provided at the left end of the ramp to disengage the microswitch 42 when the ramp moves leftward. A stop 118 is provided at the right side of the spring 108 both for support of the spring 108 and to seal off the valve opening mechanism from the fire extinguishing compound passing through header 26.

In operation, heat from a fire on the stove causes one or more of the fusible links 36 to break, releasing the tension on trigger 37. The trigger 37 then rotates due to the biasing of spring 114 and moves out of the notch 112. Ramp 100 is then free to move in the leftward direction, forcing rod 41 axially upward until it punctures seal 22. Fire extinguishing compound is then forced under pressure out of the container and ultimately through the nozzles 28.

Figure 3:
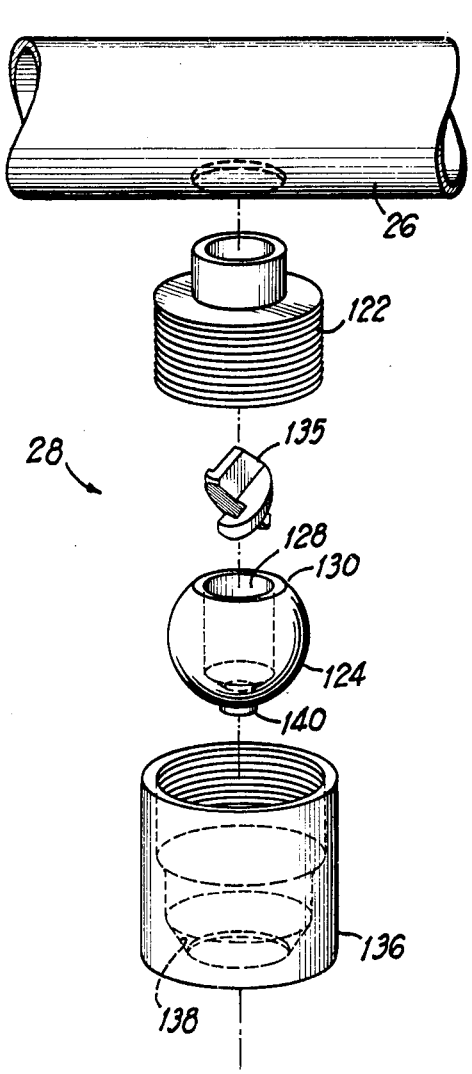
FIG. 3 is an exploded view of a nozzle of the invention.
Figure 4:
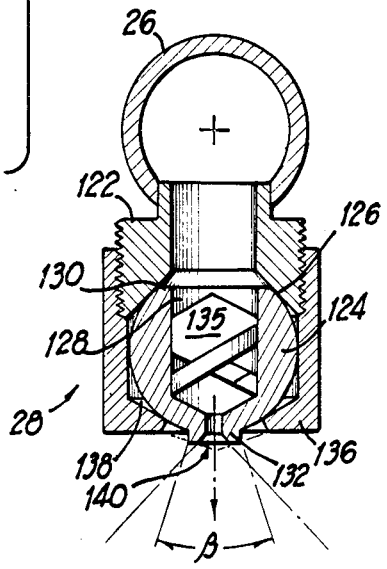
FIG. 4 is a cross-sectional view of the nozzle of FIG. 3.

FIGS. 3 and 4 illustrate a preferred construction for the nozzles 24. A nipple 122 is fitted into header 26 by brazing or other means. A ball 124 is positioned in the nipple 122 along a seat 126. The ball has an orifice 128 extending from a surface portion 130, adjacent to the nipple to a second surface portion 132 opposite the nipple. At the second surface portion, the diameter of the orifice is reduced. Generally, the large diameter portion of the orifice is between about 0.5 and about 0.2 inches, with about 0.350 and about 0.300 inches preferred. The reduced diameter portion can be from about 0.2 to about 0.100 inches with from about 0.150 to about 0.100 preferred. In a specific embodiment, the larger diameter is 0.325 while the smaller diameter is 0.125 inches. Those skilled in the art can readily determine the optimum size for a particular application. In the larger diameter portion of the orifice, a static mixer 135 can be positioned to facilitate mixing of the various components of the fire extinguishing compound. The ball is held in place on the seat 126 by means of a nut 136 which threadedly engages the nipple and has a seat 138 contacting the ball at the second surface portion 132. A short barrel 140 can be providing extending the reduced diameter portion of the orifice beyond the surface of the ball. The ball 124 is releasably and frictionally engaged by the nut 136, such that loosening of the nut permits the ball 124 to be rotated within a cone angle B, which can be from about 10° to about 60°. Once the proper adjustment has been reached, the nut 136 is tightened such that the ball is firmly held in place against both seats 126 and 138.

This nozzle design is very compact, and results in fire extinguisher installations in which the nozzle or nozzles are substantially hidden from normal viewing. Nozzles of the above design can be as little as one inch or less in overall length. The nozzles, due to the tilting of the apparatus, are positioned adjacent to the skirt 17*a* of the hood 16.

The ball 124 can have a diameter of from about ½" to about 2". Preferably the diameter is about ¾".

The valve opening mechanism 40 is also very compact compared with prior art designs and contributes to the reduction in size of the apparatus.

In general, the apparatus of the invention can be installed in a hood 16 having a depth "D" (FIG. 1) of as little as 5 inches, and a length "L" of as little as 12 inches, while still being substantially unexposed when the stove is viewed normally (i.e. in a horizontal direction).

Figure 5:
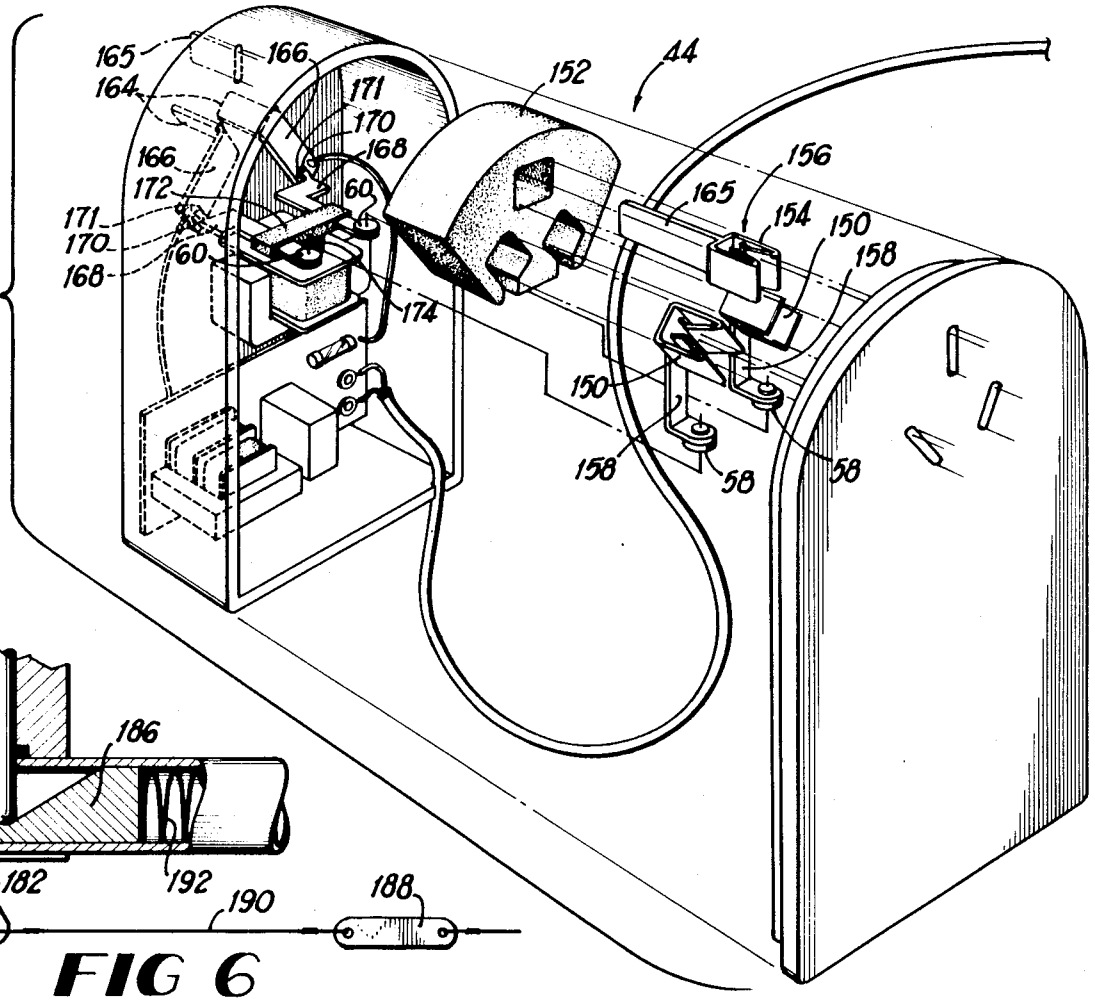
FIG. 5 is a perspective view of a preferred embodiment for the stove shut off device, showing male plugs and female receptacles in a partial exploded view.

FIG. 5 illustrates a preferred embodiment for the stove shut-off mechanism 44. In this embodiment, the arrangement of various elements is such that a very compact shape results. Compactness of this degree is important from the standpoint of installation of the shut-off mechanism in the limited space between the stove and the wall adjacent the stove in which the elecrical outlet is situated. This compact design results from the specific arrangement of the male plug, female receptors and contactors 58 and 60.

As shown in FIG. 5, the female receptors 150 are positioned in an insulating mounting block 152 along with the female receptor portion 154 of the ground 156. Secured to the female receptors 150 via conductive legs 158 are contactors 58. Extending from the rear surface of the mechanism 44 are male prongs 164 and the male portion 165 of the ground 156. The female receptors 150 and the male prongs are axially aligned as are the male and female portions of the ground 156. Each male prong 164 has a conductive leg 166 to which is journalled a conductive leg 168 of a contactor 60. The conductive legs 168 may be journalled by, for example, tongs 170 which extend from the conductive legs 168 and are received in apertures 171 in the respective conductive legs 166.

Journalling of the conductive legs 168 allows movement of the contactors 60 to either a contacting or non-contacting position with respect to contactors 58. To insure synchronous movement of contactors 60, they are joined with an insulating yoke 172. Behind the yoke 172 is a spring 174 which biases the contactors 60 to a contacting position with contactors 58. Movement of contactors 60 is controlled by coil 62.

This design eliminates much of the bulk associated with known contactor arrangements.

Figure 6:
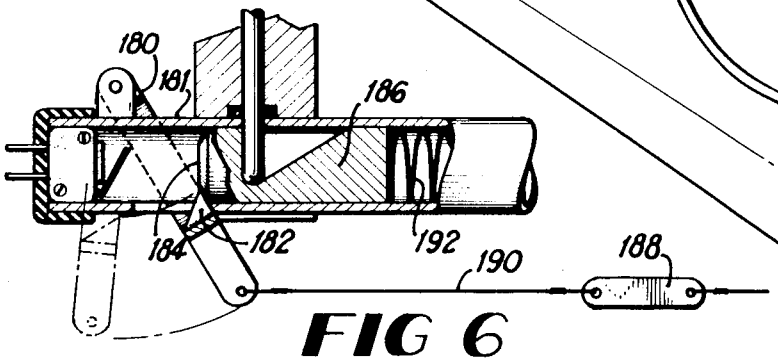
FIG. 6 is a sectional view of a second embodiment of the valve opening and triggering mechanism of the invention.

FIG. 6 illustrates an alternative embodiment for the triggering mechanism. In this embodiment, a ring-shaped trigger 180 is pivotally secured to the tube 181 and includes a cam 182 which abuts against an end 184 of ramp 186. Preferably the end 184 is beveled. The trigger is held in the position denoted by solid lines through the tension of fusible link 188 and wire 190 acting against the force of spring 192 abutting the ramp 186. Upon breakage of the link 188, trigger 180 is swung to the position shown in phantom lines. This design eliminates the need for spring 114 as shown in FIG. 2.

What is claimed is:

1. An apparatus for extinguishing a fire on a stove, the stove including a hood, the apparatus comprising:

(a) a container mounted in said hood and containing a first extinguishing compound, the container including an opening and an means for propelling said compound through the opening;

(b) a valve positioned in said opening and being operable to allow said fire extinguishing compound to exit through the opening;

(c) at least one rotatably adjustable nozzle in fluid communication with said valve to receive the fire extinguishing compound exiting through the opening, the nozzle directing the fire extinguishing compound to extinguish a fire on the stove;

(d) valve opening means contacting the valve;

(e) heat sensitive triggering means for triggering said valve opening means upon detection of said fire; and (f) said hood containing a section tilted with respect to the horizontal direction and a vertical skirt extending from an edge of said tilted direction, wherein said container, said valve and said nozzle are installed in said tilted direction, and wherein said nozzle in positioned adjacent to said vertical skirt.

2. An apparatus as claimed in claim 1, further 25 including a stove shut-off means responsive to said valve opening means for shutting off a source of heating energy to said stove when said valve is operated wherein said vessel, said valve and said nozzle are installed in the stove hood, and are at least partially hidden when the stove hood is viewed from a horizontal position.

3. An apparatus as claimed in claim 2, wherein said stove shut-off means includes a pair of female receptors each of which is axially aligned with a separate male prong.

4. An apparatus as claimed in claim 1, wherein said valve includes a rod and wherein said valve opening means includes a ramp engageable with said rod for moving said rod in an axial direction.

5. An apparatus as claimed in claim 4, wherein said heat sensitive triggering means comprises a fusible link, and wherein said triggering means includes a tension wire mechanically connecting said fusible link to said ramp, said tension wire maintaining said ramp at a position maintaining said valve in a closed position, and wherein breakage of said fusible link by the application of sufficient heat releases said tension wire, such that said ramp moves to a position resulting in said valve releasing said fire extinguishing compound from said container.

6. An apparatus as claimed in claim 1, wherein said container is positioned in said hood at an angle of from about 14° to about 45° from a horizontal position

7. A apparatus for extinguishing a fire on a stove, the stove including a hood, the apparatus comprising:

(a) a container mounted in said hood and containing a fire extinguishing compound, the container including an opening and a means for propelling said compound through the opening;

(b) a valve positioned in said opening and being operable to allow said fire extinguishing compound to exit through the opening, said valve including a rod moveable in an axial direction;

(c) at least one nozzle in fluid communication with said valve to receive the fire extinguishing compound exiting through the opening, the nozzle directing the fire extinguishing compound to extinguish a fire on the stove;

(d) valve opening means contacting the valve, said valve opening means including a ramp engageable with said rod for moving said rod in an axial direction;

(e) heat sensitive triggering means for triggering said valve opening means upon detection of said fire, said heat sensitive triggering means comprising a fusible link and a tension wire mechanically connecting said fusible link to said ramp, said tension wire maintaining said ramp at a position maintaining said valve in a closed position, and wherein breakage of said fusible link by the application of sufficient heat releases said tension wire, such that said ramp moves to a position resulting in said valve releasing said fire extinguishing compound from said container;

(f) stove shut-off means responsive to said valve opening means for shutting off a source of heating energy to said stove when said valve is operated, wherein said source of heating energy is electrical current, and wherein said stove shut-off means includes a first switch engageable with said ramp, a first solenoid activated by said first switch, and a second solenoid activated by said first solenoid, said second solenoid interrupting said electrical current to said stove when said valve opening means is activated; and (g) said container, said valve and said nozzle are installed in the stove hood, and are at least partially hidden when the stove hood is viewed from a horizontal position.

8. An apparatus as claimed in claim 7, wherein said apparatus includes a header connected to said opening of said container, and a plurality of said nozzles positioned in said header.

9. An apparatus as claimed in claim 8, wherein each of said nozzles comprises (1) a ball having an orifice extending therethrough, (2) a nipple secured at one end to said header and having at the other end a first seat engaging a first surface portion of said ball, and (3) a nut engageable with said nipple and having a second seat releasably and frictionally engaging a second surface portion of said ball, wherein said ball is rotatably adjustable between said first and second seats when said nut is in a releasing position, and wherein said ball is fixedly secured between said first and second seats when said nut is in an engaging position frictionally contacting said second portion of said ball.

10. An apparatus as claimed in claim 9, wherein said orifice extends to said second portion of said ball, and wherein said nozzle includes a barrel extending from said second portion and including said orifice.

11. An apparatus as claimed in claim 9, wherein said orifice has a first diameter extending from said first surface portion of said ball a first length into said ball, and has a second diameter smaller than said first diameter extending from said first diameter to said second surface portion of said ball.

12. An apparatus as claimed in claim 11, wherein said orifice contains a static mixer positioned within said first diameter to facilitate mixing of the various components of the fire extinguishing compound.

* * * * *